United States Patent [19]

Stafford

[11] Patent Number: 4,476,958

[45] Date of Patent: Oct. 16, 1984

[54] SAFETY DEVICE FOR SCAFFOLD

[76] Inventor: Lawrence Stafford, 8 Gracemore St., Albany, N.Y. 12203

[21] Appl. No.: 415,756

[22] Filed: Sep. 7, 1982

[51] Int. Cl.[3] ..... E04G 5/04

[52] U.S. Cl. ..... 182/82; 182/229; 182/19

[58] Field of Search ..... 182/229, 230, 142, 143, 182/82, 87, 93, 19, 112, 4

[56] References Cited

U.S. PATENT DOCUMENTS

| | | | |
|---|---|---|---|
| 12,145 | 8/1903 | Whitner | 182/4 |
| 613,971 | 11/1898 | Cody | 182/82 |
| 770,685 | 9/1904 | Haas | 182/229 |
| 1,890,029 | 12/1932 | Delfs | 182/87 |
| 2,228,042 | 1/1941 | Zanger | 182/230 |
| 3,119,590 | 1/1964 | Ericksson | 182/82 |
| 3,347,339 | 10/1967 | Coole | 182/36 |

FOREIGN PATENT DOCUMENTS

| | | | |
|---|---|---|---|
| 58042 | 8/1982 | European Pat. Off. | 182/87 |
| 207052 | 12/1939 | Switzerland | 182/87 |

*Primary Examiner*—R. P. Machado

[57] ABSTRACT

A safety device for securing a scaffold to the side of a building in order to prevent movement thereof is disclosed. Such securing of the scaffold is achieved by placing a lanyard around the rope supporting the scaffold and securing the lanyard to a stud on the side of a building through the use of a yoke.

10 Claims, 8 Drawing Figures

SAFETY DEVICE FOR SCAFFOLD

TECHNICAL FIELD

The invention relates to a safety device for securing a scaffold to the side of a building in order to prevent movement thereof and the dangerous conditions attendant thereto.

BACKGROUND ART

Moveable scaffolds are used by workmen for many external maintenance tasks. These tasks may include repairs to the outside surface of the building, modifications of the same, window washing, pointing and the like. Such devices are well known and take a wide variety of forms. Likewise, for many years, the hazards associated with such moveable scaffolds are also well known. These hazards include, by way of example, displacement of the scaffold due to movement of workers on the scaffold or due to wind or other environmental factors. At least as early as the beginning of this century, various means have been proposed for improving the stability of scaffolds. For example, in U.S. Pat. No. 770,685, use of a bracket to attach a scaffold to a building is suggested. Likewise, U.S. Pat. No. 3,347,339 of Coole and No. 2,228,042 of Zanger, other stabilizing arrangements are suggested.

In spite of the plethora of safety devices for increasing the stability of moveable scaffolds, such safety systems have not seen widespread employment because of fundamental problems which they suffer from. In particular, in order for a scaffold stabilizng device to be acceptable, it must be convenient to attach and detach; it must be dependable; and, finally, it must be of such a nature that the workers on the scaffold will actually use them. In addition, cost considerations dictate that any device used be economical and require a minimum of maintenance.

Most recently, newly constructed buildings are being equipped with tracks which are integral with the side of the external building wall. These new systems have experienced great success and this has pointed out the real importance of finding an acceptable system which may be retrofitted into existing structures. Indeed, the dependability of such systems and the ease with which they may be used has been dramatically illustrated by the feats of a number of "daredevils" who have utilized these systems to climb the sides of some of the world's tallest buildings. Nevertheless, while these most modern systems may, in theory be retrofitted to existing structures, the cost involved with such retrofittings are so high as to remove this from the range of desirable alternatives.

DISCLOSURE OF INVENTION

The invention, as claimed, is intended to provide a remedy. It solves the problem of providing an easily retrofittable system for the outside of a building to stabilize scaffolding. The same is achieved by providing the building with a system of anchors which are easily mounted in a wide variety of building surfaces and by providing the scaffolds with a spring loaded yoke which mates with and attaches to the anchors.

BRIEF DESCRIPTION OF DRAWINGS

One way of carrying out the invention is described in detail below with reference to the drawings which illustrate only one specific embodiment, in which.

BEST MODE FOR CARRYING OUT THE INVENTION

Figure 1:
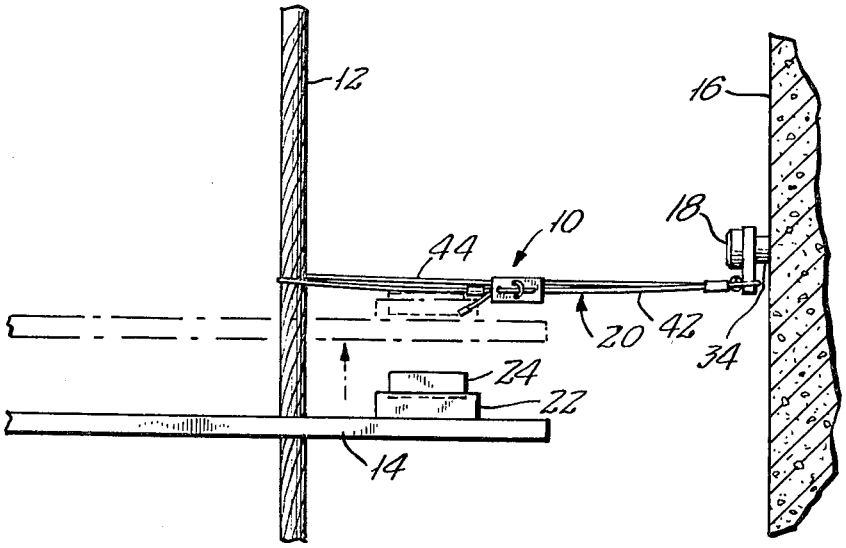
FIG. 1 is a plan view of the inventive system.

Turning first to FIG. 1, the inventive system 10 for securing a cable 12 bearing a scaffold 14 from swaying to far from the wall of a building 16, is illustrated. In general, the inventive system 10 works by securing cable 12 to an anchor 18 on the side of building 16 by an adjustable lanyard assembly 20. Generally, undesirable movement of the scaffold 14 is prevented by limiting the movement of support cable 12. In accordance with the preferred embodiment of the invention, it is contemplated that anchors 18 are installed on the side of the building at spaced intervals at points which correspond to the path which the support cable 12 follows during use of the scaffold. Generally, it is contemplated that anchors 18 are to be installed in pairs corresponding to the two support cables 12 which support the scaffold at vertical distances corresponding to a separation of three stories or, approximately, every forty feet.

Generally, the system 10, illustrated in FIG. 1, works by limiting the extent to which support cable 12 is free to sway, as a result of wind or other environmental factors, from the rest position with respect to the building 16. Inasmuch as the system is secured to the anchor manually, it is possible for a worker inadvertantly to try to raise the platform 14 while the system 10 is still in place. As a possible added safety feature, the invention contemplates the use of an electrical switch 22 which, when the platform is raised to the position illustrated in phantom lines in FIG. 1, will result in depression of the actuator 24 of the switch and, accordingly, a change in the electrical state of the switch. This change of state may be detected by a suitable control apparatus and used to disable the electrical or other mechanical means being used to raise and lower the scaffold 14. Switch 22 may be any of a number of possible well known systems which include large actuators 24 which may be easily and reliably engaged with the lanyard assembly 20 due to the large surface area of the actuator 24 and the sensitivity of the electrical switch.

Figure 2:
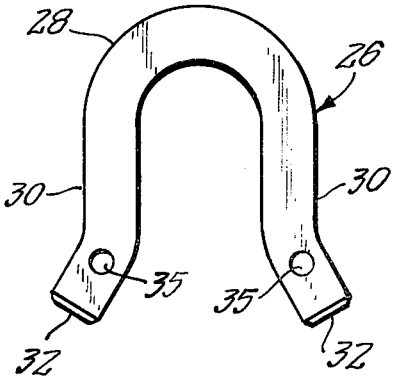
FIG. 2 is a plan view of the yoke of the inventive system.

As shown most clearly in FIG. 2, the system 10 comprises a yoke 26 which includes a rounded portion 28, a pair of straight portions 30 and a pair of ear portions 32. The inner diameter of rounded portion 28 has a radius substantially equal to the radius of the support post portion 34 (FIG. 3) of anchors 18. Yoke 26 also includes a pair of holes 35 in the ear portion of the yoke.

Figure 3:
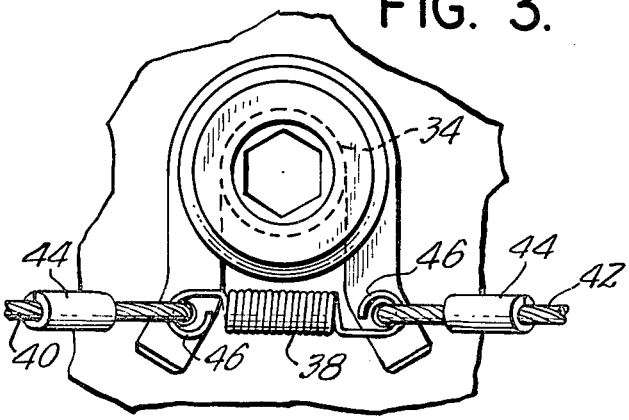
FIG. 3 is a plan view of the yoke and its associated parts in engagement with an anchor mounted on the side of the building.
Figure 4:
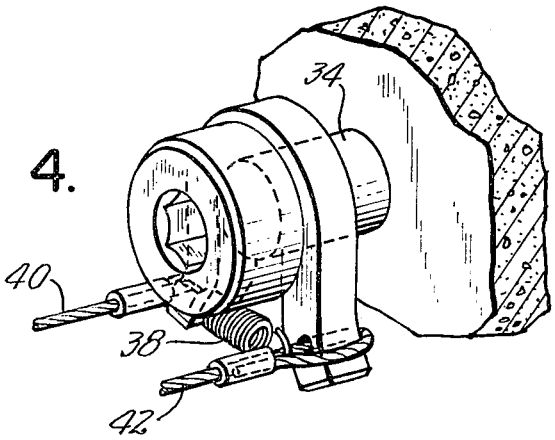
FIG. 4 is a perspective view of the yoke and anchor portion of the inventive system during use.
Figure 5:
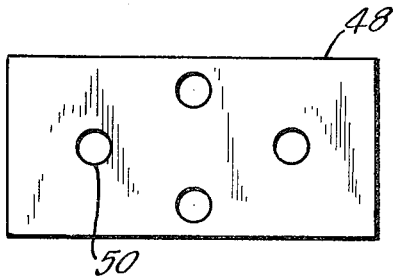
FIG. 5 is a plan view of a cable lock used in the system of the present invention.
Figure 6:
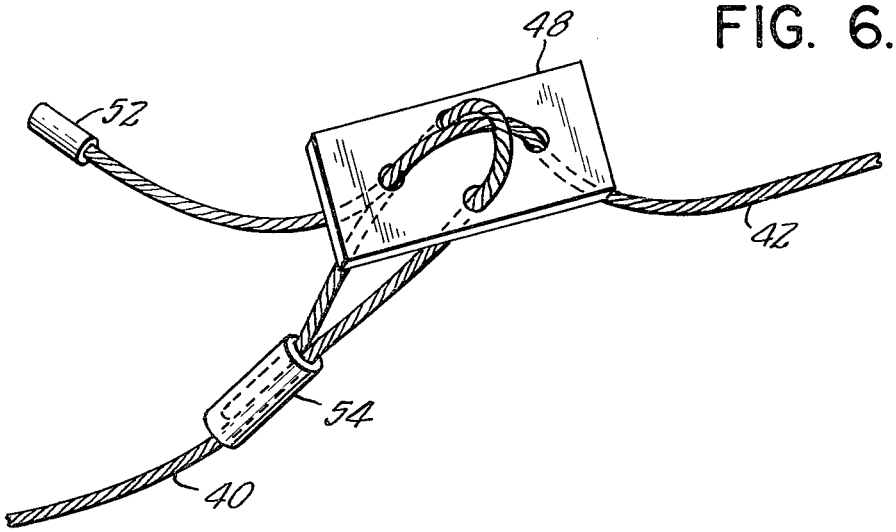
FIG. 6 is a perspective view of the cable lock showing its operation.

As shown in FIGS. 3 and 4, yoke 26, when it is secured to an anchor 18 is disposed around the support post portion 34 of the anchor 18. It is retained in the position by a spring 38. The main support function is provided by a fixed lanyard 40 and an adjustable lanyard 42. Lanyards 40 and 42 are secured to yoke 20 by being passed through holes 35 and having their ends closed into loops under compression fittings 44. Spring 38, in turn, is secured to the assembly by having its ends 46 secured around the loops formed at the ends of lanyards 40 and 42. The adjustable lanyard and the fixed lanyard are secured together by a cable lock 48 which includes a plurality of holes 50 (FIG. 5). As shown in FIG. 6, two of the holes receive the end of the adjustable cable opposite that end of the adjustable cable 42 which is secured to the yoke. The very end of this end of the adjustable cable 42 is, in turn, provided with a compression fitting 52 which prevents the cable of a lanyard from unwinding and, in the event of extreme stresses and sliding prevents the adjustable cable from becoming disengaged from the cable lock. The end of the fixed cable 40 opposite that end which is secured to yoke 26 is formed into a loop which passes through two of the holes of the cable lock, as illustrated in FIG. 6. This loop is, in turn, closed by compression fitting 54.

Figure 7:
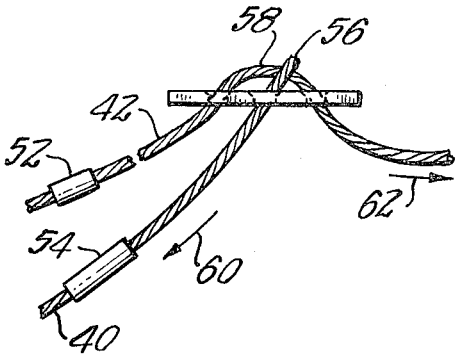
FIG. 7 is a side plan view showing the operation of the cable lock of FIGS. 5 and 6.

As is illustrated in FIG. 7 this particular arrangement of a cable lock is particularly advantageous inasmuch as the relatively adjustable free end of adjustable cable 42 is, during use, compressed against the cable lock 48 by the loop 56 formed at the end of cable 40. In particular, the underside of loop 56 bears against the top 58 of that portion of cable 42 which passes through cable lock 48 when forces in the direction of arrows 60 and 62 are applied the the lanyard. It is noted that during use, in the event that the cable begins to sway, such forces will be applied to the lanyards.

Figure 8:
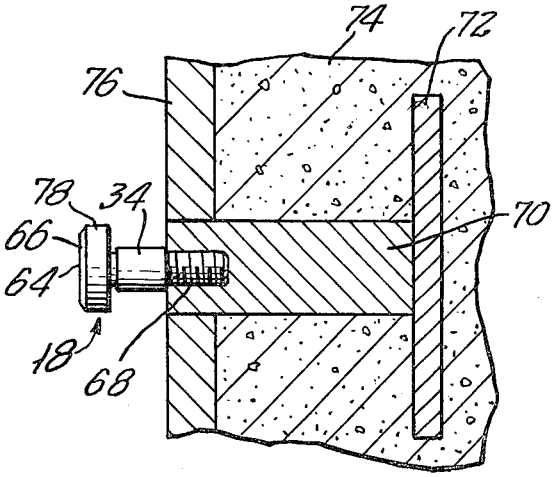
FIG. 8 is a cross-sectional view showing one system for the mounting of an anchor in a building element.

As illustrated in FIG. 8 the anchor 18 used in accordance with the present invention, comprises a flat portion 64 and a bevelled front edge 66. The end of the anchor which is to be secured to the building is provided with threads 68 which, in turn, mate with a tapped hole in a metal receiving member 70 which, in turn is secured to a bar 72, which is securely lodged within the core 74 of a precast masonry element 76. Of course, other anchoring means may be used to provide a tapped hole in a building element. For example, in the event that the anchor 26 is to be secured to a metal element having a relatively thin wall, e.g., an extrussion, one may use a fastener of the type marketed by B. F. Goodrich under the trademark "Rivnut". Alternatively, if a relatively thickly walled concrete element is encountered in a retrofitting application, one may use a device such as the anchoring device marketed by ITT Phillips Drill Division under the trademark "Redhead" and bearing catalog number RM-38.

While the invention is capable of employment using a wide range of material and dimensions, in a system in which the diameter of rounded portion 28 was one-half of one inch, and the yoke 26 had the shape illustrated in FIG. 2, particular success has been achieved by making the yoke of cold drawn 18-8 stainless steel. Likewise, anchors 26 are most easily provided by using standard socket shoulder screws having substantially the configuration illustrated in FIG. 8 and made of stainless steel. Lanyards were made using 1/16 inch 7×7 flexible galvanized aircraft cable. Likewise, springs made of stainless steel having a free length of 28.5 mm. and rated at 0.267 kg/mm were found to give suitable results. While not every aspect of the configuration of the yoke is critical, it was found that ear portions 32 must be of minimum length in order to prevent the loops at the ends of the lanyards from becoming entangled. In particular, the length shown in FIG. 2 was found to yield acceptable results.

When it is desired to use the system of the present invention, a plurality of devices 10 according to the system in the present invention are secured around the support cables 12 which support the scaffold 14. As the scaffold is lowered past the first set of anchors 26, the workman on the scaffold attaches the yoke to the anchor by first placing the inside of the yoke 26 over the head 78 of the anchor. The yoke is then pushed downwardly while at the same time being advanced toward the building, thus stretching the spring. Once this action has progressed to a limited extent, the anchor will be brought into snapping engagement with the yoke and the system properly secured. Removal is achieved by first placing the index finger of the left hand of the workman underneath the spring and advancing the spring over the face 64 of the anchor. The spring may be maintained in this position by using the middle finger of the left hand to retain it in this position. The two index fingers of the workman are then used to urge the yoke inwardly. This action has the effect of disengaging the anchor.

While an illustrative embodiment of the invention has been disclosed, various modifications of the invention may be made by those of ordinary skill in the art without departing from the spirit and scope of the invention which is defined and limited only by the appended claims.

I claim:

1. A safety system, comprising:

(a) a plurality of anchors secured to a building;

(b) yoke means having a generally U-shaped element configured and dimensioned to be fitted on and secured around one of said plurality of anchors, said anchors having support and heads and being disposed vertically at spaced intervals along the outside surface of the building;

(c) spring means for maintaining said yoke means on said anchors;

(d) a scaffold; and (e) lanyard means secured to said yoke means and adapted to be secured to said scaffold which moves vertically along the side of the building.

2. A safety device as in claim 1, wherein said U-shaped element has a pair of holes at its ends and said spring means comprises a coil type spring having each of its ends secured about a point corresponding to a respective one of said holes.

3. A safety device as in claim 1, wherein said lanyard means includes a fixed and a movable lanyard which are secured together by a buckle.

4. A safety device as in claim 3, wherein said buckle includes four holes and the first end of said fixed lanyard comprises a closed fixed loop which passes through two holes and the end of said adjustable lanyard comprises a free single open string which passes underneath said loop and forms a second loop underneath said first loop whereby application of tension to said first and second lanyards results in urging said first loop against said second loop to increase the friction between the lanyard forming said second loop and said buckle whereby the adjustable lanyard is caused to positively engage said buckle.

5. A safety device as in claim 2 or 4, wherein said lanyard has a pair of loops at its ends which pass through said holes and said spring is secured to said holes by being secured through and passed into said loops.

6. A safety as in claim 4, wherein said spring is secured to said loops adjacent a side of said yoke which is opposite the side of the yoke which is adjacent to the building.

7. A safety device as in claim 1, 4 or 6, wherein said yoke comprises a pair of extended ear portions adjacent said holes.

8. A safety device as in claim 7, wherein said head of said anchor has a sharp right angle edge adjacent said building, and a bevelled edge on the opposite surface of said head.

9. A safety device as in claim 7, wherein said lanyard is secured to said scaffold by being secured around a cable surrounding said scaffold.

10. A safety device as in claim 9, wherein said scaffold is provided with a motor means for raising and lowering said scaffold, and a switch which will engage the lanyard in the event that the scaffold is attempted to be raised above the level of a safety device and control means responsive to said switch to stop operation of said motor means.

* * * * *